US006558481B1

(12) United States Patent
Adachi et al.

(10) Patent No.: US 6,558,481 B1
(45) Date of Patent: May 6, 2003

(54) METHOD OF CONTROLLING PROPERTIES OF A FERROMAGNETIC SAMARIUM SUBSTANCE A FERROMAGNETIC MATERIAL AND A SPIN RESOLVING DEVICE

(76) Inventors: Hiromichi Adachi, 740-6-504, Sanuki-machi, Ryugasaki-shi Ibaraki-ken (JP); Hiromitsu Ino, 7-15-5, Tamagawagakuen, Machida-shi Tokyo (JP); Hirosi Miwa, 668-11, Shimadachi, Matsumoto-shi Nagano-ken (JP)

( * ) Notice: Subject to any disclaimer, the term of this patent is extended or adjusted under 35 U.S.C. 154(b) by 0 days.

(21) Appl. No.: 09/831,790

(22) PCT Filed: Sep. 17, 1999

(86) PCT No.: PCT/JP99/05091

§ 371 (c)(1),
(2), (4) Date: May 14, 2001

(51) Int. Cl.[7] ..... H01F 1/04
(52) U.S. Cl. ..... 148/301; 148/101
(58) Field of Search ..... 148/301, 101

(56) References Cited

FOREIGN PATENT DOCUMENTS

| | | |
|---|---|---|
| JP | 08-248141 | 9/1996 |
| JP | 11-144927 | 5/1999 |

OTHER PUBLICATIONS

English language transltion of Japanese Patent Document No. 11–144927, May 28, 1999.*

* cited by examiner

*Primary Examiner*—John Sheehan
(74) *Attorney, Agent, or Firm*—Pearne & Gordon LLP

(57) ABSTRACT

An appropriate ferromagnetic substance, whose magnetization arises mainly from samarium, is selected, and the composition of this ferromagnetic samarium substance is, according to necessity, modified by an atomic substitution or addition; whereby the two parts of the magnetization originating from the orbital magnetic moment and the spin one compensate with each other and the resultant total magnetization becomes close to zero. An external magnetic field is applied to this ferromagnetic samarium substance at a temperature, where it has a finite magnetization, so as to align the electron spin polarization therein over a macroscopic range, and, subsequently, the temperature is set to be the magnetization-compensation temperature and the applied field is reduced to be nearly zero; whereby this ferromagnetic samarium substance can have a specific property. Since this property is useful to generate a spin-polarized charged-particle beam, to measure the spin polarization, and to polarize or analyze the spin for a charged-particle flow (an electric current), this ferromagnetic samarium substance can be a material for a spin-resolving device.

13 Claims, 4 Drawing Sheets

(a)

(b)

(c)

METHOD OF CONTROLLING PROPERTIES OF A FERROMAGNETIC SAMARIUM SUBSTANCE A FERROMAGNETIC MATERIAL AND A SPIN RESOLVING DEVICE

TECHNICAL FIELD

This invention pertains to a method of controlling properties of a ferromagnetic samarium substance whereby the substance becomes suitably used as a spin-resolving device for charged particles and also pertains to a ferromagnetic material adapted to be controlled by this method and a spin-resolving device making use of the relevant properties.

TECHNICAL BACKGROUND

Magnetic substances are extensively used in various fields as permanent magnets, soft magnetic materials, and magnetic recording media. When magnetic substances are used as such materials, the magnetization or a magnetic field generated thereby, the interaction with an external magnetic field, and so on, are essentially utilized.

On the other hand, coupled with the recent researches on the particle-spin dependence of various interactions in the fields of high-energy physics, solid-state physics, and so on, an improvement of the technology to produce the spin-polarized particles or to measure the spin polarization has been desired.

In a magnetic substance, the electron spin is spatially polarized in a temperature range below a specific temperature called the magnetic transition point. Therefore, it is naturally thought that magnetic substances could be suitable materials for a spin-resolving device for charged particles.

Practically, however, magnetic substances, especially ferromagnetic ones, are rarely used in the spin-resolving technology; but instead, for example, a semiconductor excited by a circularly polarized laser beam is used as a polarized electron-beam source, and the diffraction and/or scattering of an electron beam from heavy elements such as gold, tungsten, etc., or the emission of a circularly polarized light from a GaAs film irradiated with an electron beam is used in the measurement of the spin polarization of an electron beam (see JP08-248141).

The main reason for the inapplicability of ferromagnetic substances to the spin-resolving device resides in the fact that the ferromagnetic ordering of the electron spin over a macroscopic range is usually accompanied with the generation of a finite magnetization. The magnetization of a ferromagnetic substance is unfavorable for the application to the spin-resolving device in the following two points.

Firstly, under no magnetic field, a ferromagnetic substance usually tends to split into many small domains with different directions of the electron spin polarization to energetically stabilize. In other words, the macroscopic spin polarization does not spontaneously occur despite the ferromagnetic nature. And, it is difficult in general to control and evaluate such a magnetic-domain structure.

Secondly, when a ferromagnetic spin polarization is attained over a macroscopic range somehow, the ferromagnetic substance itself generates a stray magnetic field. In the case that an external magnetic field is applied to achieve the macroscopic spin polarization, there also exists a stray magnetic field from an apparatus generating the external field. Such stray fields might affect the charge and/or the spin magnetic moment of a spin-polarized charged particle in the form of the Lorentz force, the magnetic force, and the Larmor precession.

One object of the invention is to provide a method of controlling properties of a ferromagnetic material, whereby it becomes suitably available for the spin-resolving technology for charged particles, which has no undesirable effect on the charge and/or the spin magnetic moment of the charged particle.

Another object of the invention is to provide a ferromagnetic material, where the properties suitable for the spin-resolving technology are easily materialized and controlled.

Further object of the invention is to provide a spin-resolving device for charged particles, which comprises a ferromagnetic material and, nonetheless, is free from the formation of magnetic domains and the leakage of a magnetic field.

DISCLOSURE OF THE INVENTION

A first feature of the invention is to control properties of a ferromagnetic substance, whose magnetization arises mainly from the element of samarium and in a method of this feature, the present ferromagnetic substance is so controlled as to keep a ferromagnetic alignment of the electron spin over a macroscopic range and to have a spin-orbital compensation property characterized by little or no magnetization due to the compensation between the two parts of the magnetization originating from the orbital magnetic moment and the spin one.

This spin-orbital compensation property can be attained at an arbitrary temperature by an appropriate modification of the composition of the ferromagnetic samarium substance and an appropriate preliminary thermomagnetic process.

The composition of the ferromagnetic samarium substance is controlled by, according to the relation in size between the partial magnetization originating from the orbital magnetic moment and that originating from the spin one, replacing a part of samarium in the base substance with other elements or adding other elements to the base substance so as to reduce the total magnetization.

A second feature of the invention lies in a ferromagnetic material, whose magnetization arises mainly from samarium and adapted to keep a ferromagnetic alignment of the electron spin therein over a macroscopic range and have a spin-orbital compensation property characterized by little or no magnetization due to the compensation between the two parts of the magnetization originating from the orbital magnetic moment and the spin one.

This ferromagnetic material is based on a ferromagnetic substance, whose magnetization arises mainly from samarium, and the composition of the ferromagnetic material is controlled by, according to the relation in size between the partial magnetization originating from the orbital magnetic moment and that originating from the spin one, replacing a part of samarium in the base substance with other elements or adding other elements to the base substance so as to reduce the total magnetization.

A third feature of the invention is to generate a spin-polarized charged-particle beam, measure the degree of the spin polarization or polarize or analyze the spin for a charged-particle flow (an electric current), making use of a spin-orbital compensation property of the ferromagnetic material, which serves as a spin-resolving device for charged particles.

As aforementioned, the ferromagnetic material of the invention comprises a substance, whose magnetization arises mainly from samarium, (referred to as "ferromagnetic samarium substance" hereafter) and the property suitable for the spin-resolving technology is the state, where the ferromagnetic samarium substance keeps the electron spin polarization aligning in one direction over a macroscopic range and has little or no magnetization.

This property of a ferromagnetic samarium substance can be basically attained by an appropriate modification of the composition and an appropriate preliminary thermomagnetic process. The reasons for that are described hereinafter.

Samarium usually has five 4f electrons in solids, but sometimes has six ones. In the following descriptions, only the former samarium is dealt with and is just called "samarium" hereafter.

For samarium, the spin magnetic moment due to the electrons' spin polarization and the orbital magnetic moment due to the electrons' orbital motion are almost the same in size, and couple in an opposite direction as a result of a relativistic effect, called the spin-orbit interaction, to form the total magnetic moment.

Therefore, a ferromagnetic samarium substance is intrinsically characterized by a quite small net magnetization owing to the marginal cancellation between the two parts of the magnetization originating from the spin magnetic moment and the orbital one.

Also, samarium is characterized by the difference in temperature dependence between the spin magnetic moment and the orbital one, which is ascribed to the narrow energy interval of about 1500 K (130 meV) between the ground J-multiplet (the lowest energy state) of the 4f electrons and the first excited one.

In consequence of these two characteristics, the thermal average of the total magnetic moment of samarium in a temperature range below the magnetic transition point strongly depends on the local environment of samarium in solids, and can present unique temperature dependence different from the cases of other magnetic ions. It is known that the local environment of an ion has an influence, to some extent, on the magnitudes of the orbital and/or spin magnetic moment of the ion. The thermal average of the total magnetic moment of samarium, formed by the marginal cancellation between the orbital and spin parts, therefore, is subjected to relatively strong influence as described above, and the temperature dependence can be a unique one reflecting the difference in temperature dependence between the orbital and spin magnetic moments.

Since this unique temperature dependence of the total magnetic moment of samarium becomes easy to understand by comparing with the temperature dependence (thermal magnetization curve) of the magnetization for a ferrimagnetic body, let's analogize these two cases below.

Various types of the temperature dependence of the magnetization for a ferrimagnetic body are caused by the difference in temperature dependence between the magnetic moments of different kinds of magnetic elements, which couple in an opposite direction, whereas various types of the temperature dependence of the total magnetic moment of samarium in a ferromagnetic samarium substance are caused by the difference in temperature dependence between the spin and orbital magnetic moments of each samarium.

Of such a temperature dependence of the total magnetic moment of samarium, three typical ones are schematically shown in FIG. 1, and it can be seen that these curves resemble the magnetization versus temperature curves for ferrimagnetic bodies.

Since the spin magnetic moment of samarium usually less reduces as the temperature increases in a low temperature range and more steeply varies in the vicinity of the magnetic transition point than the orbital one, each curve shown in FIG. 1 can be interpreted as follows.

Curve (1) having a broad maximum means the temperature dependence of the total magnetic moment of samarium in the case that the spin magnetic moment is larger than the orbital one, and curve (2) gently sloping means the temperature dependence in the case that the orbital magnetic moment is larger than the spin one. Curve (3), where the thermal average of the total magnetic moment becomes zero at a specific temperature below the magnetic transition point, means the temperature dependence in the case that the orbital magnetic moment is larger and smaller than the spin one below and above that temperature, respectively, and the two exactly cancel out just at that temperature, where the thermal average is equal to zero.

As speculated from the aforementioned analogy with a ferrimagnetic body, for a ferromagnetic samarium substance, a perfect compensation between the two parts of the magnetization originating from the spin magnetic moment and the orbital one can be materialized at a specific temperature.

Therefore, by applying an external magnetic field to a ferromagnetic samarium substance at a temperature, where it has a macroscopic magnetization, so as to align the electron spin polarization therein over a macroscopic range, and, subsequently, setting the temperature to be the spin-orbital compensation temperature and reducing the applied field to be nearly zero, the state with the electron spin polarization aligning in one direction over a macroscopic range and no magnetization can be materialized. In that state, the stability of the spin polarization is kept by a strong anisotropy due to the orbital magnetic moment of samarium.

The present invention makes use of such a spin-orbital compensation property, but all ferromagnetic samarium substances do not have this property. It is then required to modify the composition of a ferromagnetic samarium substance to suitably make use of this property. This modification of the composition can be basically attained by an appropriate amount of the atomic substitution or addition to a ferromagnetic samarium substance.

This modification of the composition of a ferromagnetic samarium substance can be performed by either of the following two methods.

One method is to replace a part of constituents in a ferromagnetic samarium substance with non-magnetic elements having no magnetic moment or to add non-magnetic elements to a ferromagnetic samarium substance. Since such a replacement or an addition with non-magnetic elements changes the local environment of samarium, the temperature dependence of the total magnetic moment of samarium can be varied through this change of the environment. It should be noted that this type of the modification of the composition has to be so performed that a remarkable change in magnetic property, especially a change of the alignment of the spin magnetic moment from a ferromagnetic one to an antiferromagnetic one or a considerable fall of the magnetic transition point, does not occur.

Another method is to replace a part of samarium with other magnetic rare-earth element, where the ratio between the spin magnetic moment and the orbital one is different from the case of samarium. Since such a replacement with other rare-earth element changes the ratio between the two partial magnetizations originating from the spin and orbital magnetic moments in the resultant magnetization of a ferromagnetic samarium substance, the net magnetization can be reduced through this change of the spin/orbital ratio.

More particularly, it is generally easy to replace a rare-earth element with the other one, since the ionic radii of rare-earth elements are close to each other. In addition, it is empirically known that, when the spin magnetic moment of rare-earth element aligns ferromagnetically in a base substance, the spin magnetic moment of substitutive rare-earth element basically keeps a ferromagnetic coupling with the neighboring spins.

Therefore, for a ferromagnetic samarium substance, where the orbital part of the magnetic moment of samarium is larger than the spin one, a reduction of the total magnetization and a spin-orbital compensation can be attained by replacing a part of samarium with the heavy rare-earth elements having seven 4f electrons or over, where the spin magnetic moment contributes positively to the total one. Contrarily, for a ferromagnetic samarium substance, where the spin part of the magnetic moment of samarium is larger than the orbital one, they can be attained by replacing a part of samarium with the light rare-earth elements having less than seven 4f electrons, where the spin magnetic moment contributes negatively to the total one.

There is, thus, provided a ferromagnetic samarium substance, which keeps a ferromagnetic alignment of the electron spin therein over a macroscopic range and has no magnetization.

It is understood that the principal driving force for the formation of magnetic domains is the magneto-static energy. For a ferromagnetic material having a spin-orbital compensation property of the invention, on the other hand, there is no positive reason for the formation of magnetic domains because of lack of the magnetization. That is to say, the formation of magnetic-domain structure yields no energy gain and the boundary region concomitant with the formation of magnetic domains (the domain wall) is energetically unfavorable in terms of an anisotropic nature of each magnetic moment and the inter-ionic exchange interaction.

Furthermore, the magnetic moment of the magnetically ordered samarium usually has a strong anisotropy due to the orbital magnetic moment, and the direction is not drastically changed in solids, unless a demagnetizing field and/or an external magnetic field higher than a specific value is applied in that direction. Therefore, once a ferromagnetic samarium substance keeps a ferromagnetic alignment of the electron spin therein over a macroscopic range, the direction of the electron spin polarization must be stably kept at the magnetization-compensation temperature. Also, since a ferromagnetic samarium substance having a spin-orbital compensation property has little or no magnetization, a stray magnetic field from there is practically zero.

Thus, a ferromagnetic samarium substance having a spin-orbital compensation property is available for the spin-resolving technology, as long as it keeps a ferromagnetic alignment of the electron spin therein over a macroscopic range without generating a magnetization. Especially, this is suitably used as a spin-resolving device for charged particles, which comprises a ferromagnetic material and, nonetheless, is free from the formation of magnetic domains and the leakage of a magnetic field.

BRIEF DESCRIPTION OF THE DRAWINGS

FIG. 4(*b*) is a schematic diagram of an apparatus to observe the surface spin structure with a ferromagnetic material of the invention; and FIG. 4(*c*) is a schematic diagram of a spin-polarized electron gun with a ferromagnetic material of the invention.

BEST MODES FOR EMBODYING THE INVENTION

Describing modes for embodying the invention in details with reference to the drawings, a ferromagnetic material of the invention comprises a ferromagnetic samarium substance, whose magnetization arises mainly from one of the constituents, samarium. This ferromagnetic samarium substance keeps the ferromagnetic alignment of the electron spin therein over a macroscopic range to fit an application in a field of spin technology, and is so controlled as to have little magnetization due to a compensation between the two parts of the magnetization originating from the orbital magnetic moment and the spin one.

As aforementioned, a ferromagnetic samarium substance having such properties can be materialized by an appropriate modification of the composition and an appropriate preliminary thermomagnetic process. Here, the modification of the composition is performed by replacing a part of the constituents with non-magnetic elements having no magnetic moment, or adding non-magnetic elements to the ferromagnetic samarium substance, or replacing a part of samarium with other magnetic rare-earth element, where the ratio between the spin magnetic moment and the orbital one is different from the case of samarium. Now, the embodiment will be described in detail with reference to FIGS. 2 and 3.

As examples of a ferromagnetic samarium substance, whose magnetization arises mainly from samarium, SmZn, SmCd, and $SmAl_2$ can be raised.

Figure 1:
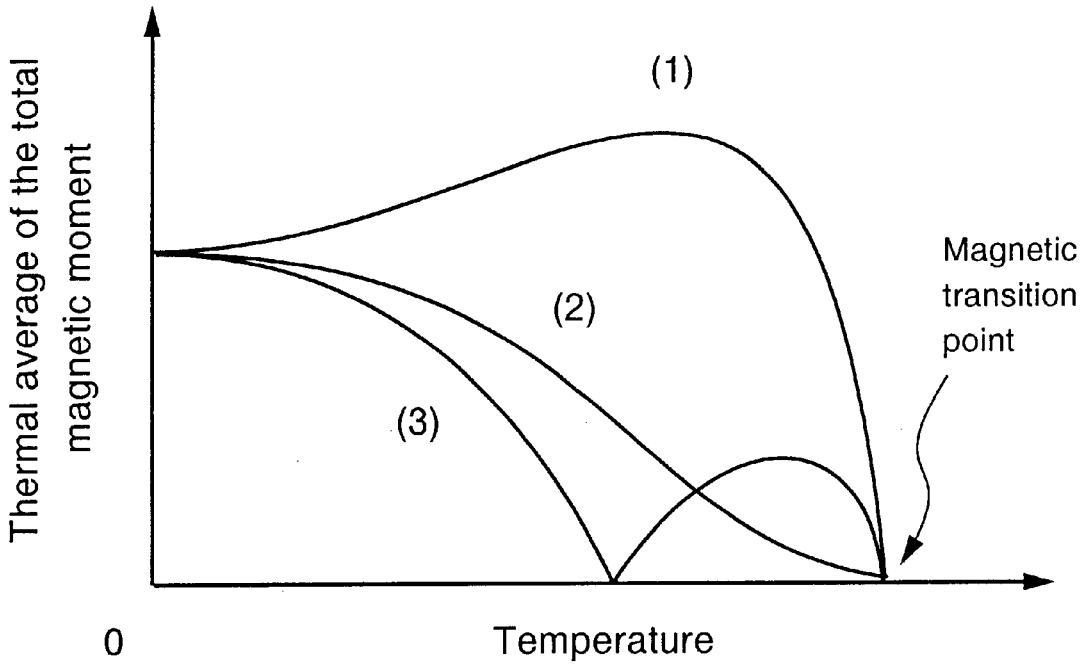
FIG. 1 schematically shows three typical temperature dependences of the total magnetic moment of samarium in a temperature range below the magnetic transition point.
Figure 2:
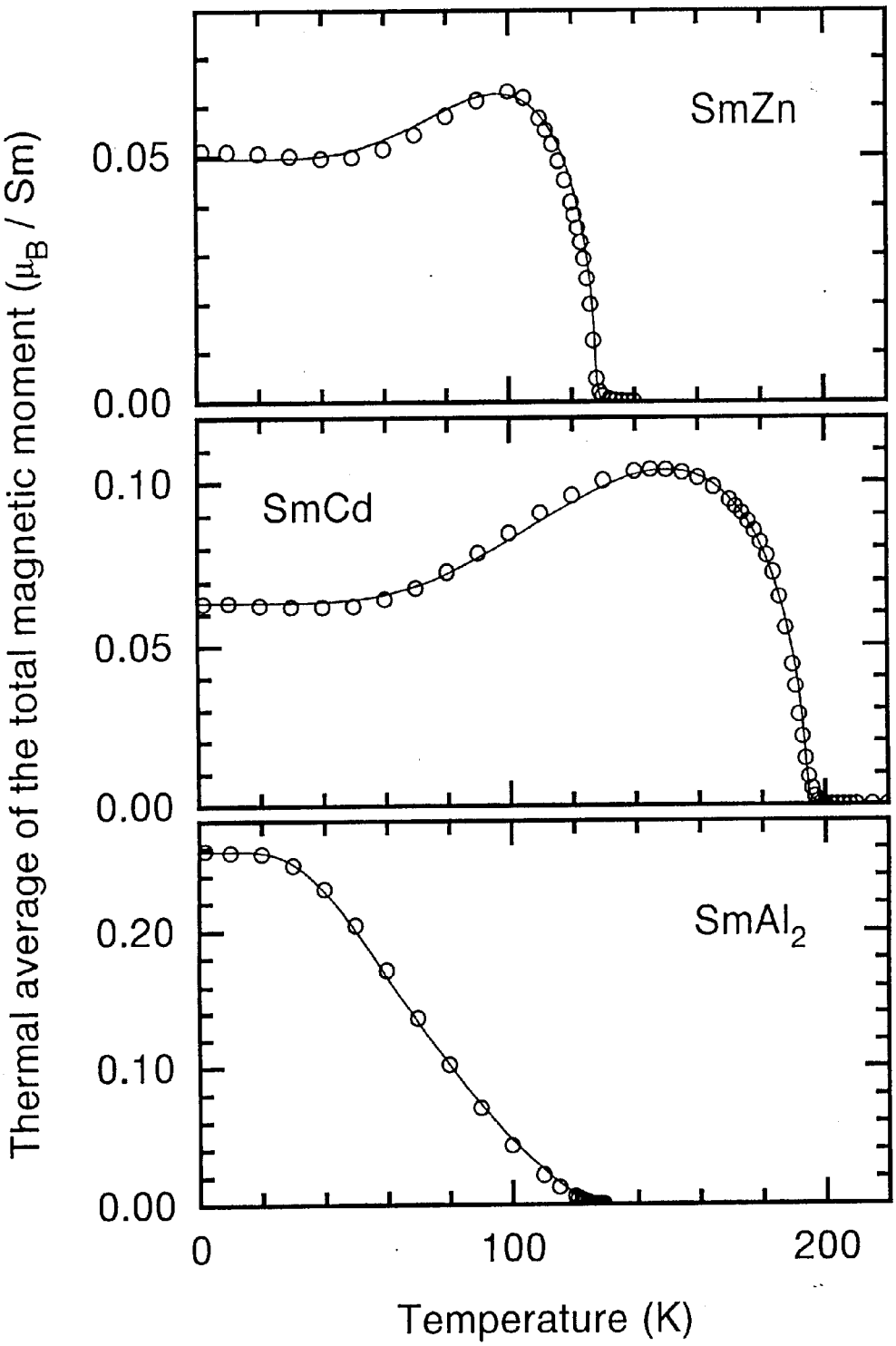
FIG. 2 shows the experimental magnetizations of ferromagnetic samarium substances, SmZn, SmCd, and $SmAl_2$, per samarium as a function of temperature.

FIG. 2 shows the temperature dependence of the total magnetic moment of samarium, obtained from the experimental thermomagnetic curves for these ferromagnetic samarium substances.

These ferromagnetic samarium substances are ferromagnetic bodies, where the spin magnetic moment of each samarium aligns parallel to each other in a temperature range below the magnetic transition point. Nevertheless, as shown in FIG. 2, the temperature dependence of the total magnetic moment resembles the magnetization versus temperature behavior of ferrimagnetic bodies very much.

The experimental values denoted by open circles in FIG. 2 are well reproduced by the theoretical calculations (solid curves in FIG. 2), and it can be confirmed that the pseudo-ferrimagnetic temperature dependence is caused by the difference in temperature dependence between the spin and orbital magnetic moments of each samarium that couple in an opposite direction. From this comparison with the theoretical calculations, it can be concluded that, of these three ferromagnetic samarium substances raised in FIG. 2, for SmZn and SmCd, the partial magnetization originating from the spin magnetic moment is larger than that originating from the orbital one, and, for $SmAl_2$, the situation is opposite.

Figure 3:
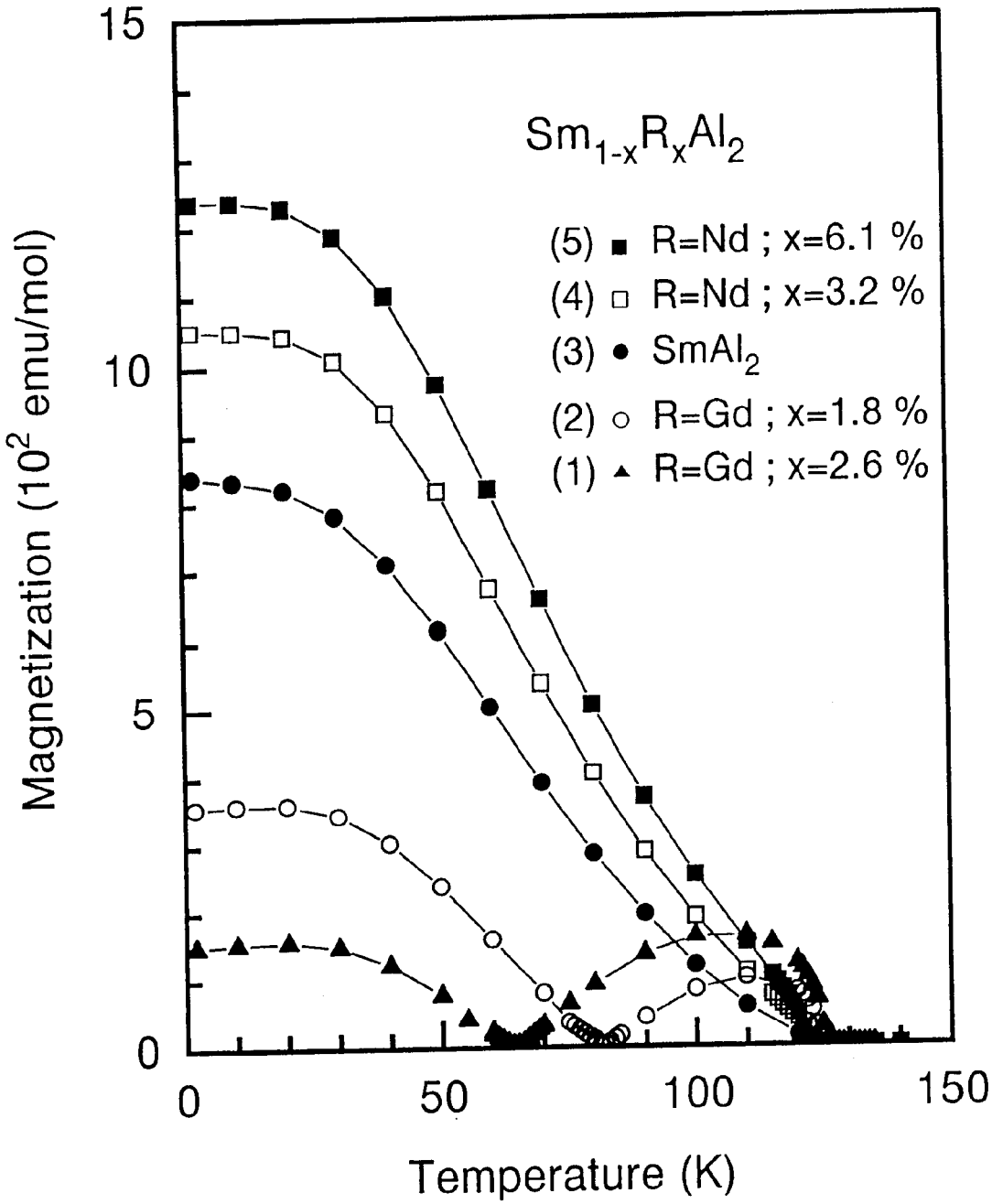
FIG. 3 shows some examples of the control for a spin-orbital compensation property of a ferromagnetic samarium substance, $SmAl_2$.

FIG. 3 shows a result of the control for a spin-orbital compensation property with replacing a part of samarium with other rare-earth elements, where a base ferromagnetic samarium substance is $SmAl_2$.

As aforementioned, since the partial magnetization originating from the orbital magnetic moment is larger than that originating from the spin one for $SmAl_2$, the net magnetization can be reduced by replacing a part of samarium with the heavy rare-earth element such as gadolinium ((1) and (2) in FIG. 3). From plots (1) and (2), it can be seen that a zero-magnetization state with the compensation between the two parts of the magnetization originating from the orbital magnetic moment and the spin one can be attained at a specific temperature by controlling an amount of the replacement with gadolinium. Plot (3) in FIG. 3 shows the property of $SmAl_2$ before replacement.

If the light rare-earth element such as neodymium is selected instead of gadolinium, the net magnetization increases contrarily ((4) and (5) in FIG. 3). That is to say, the replacement with the light rare-earth element such as neodymium has an opposite effect in the present case.

When, as in the cases of SmZn and SmCd, the partial magnetization originating from the spin magnetic moment is larger than that originating from the orbital one for a base substance, the spin-orbital compensation property can be improved by replacing a part of samarium with the light rare-earth element such as neodymium. Though concrete samples with such a replacement with neodymium and the resultant thermomagnetic properties are not illustrated, it can be easily inferred from the examples shown in FIG. 3 that a zero-magnetization state can be attained at an arbitrary temperature by controlling an amount of the replacement.

Also, no example of the control for a spin-orbital compensation property of a ferromagnetic samarium substance with a replacement or an addition with non-magnetic elements is illustrated here, too. However, the replacement with the non-magnetic element having similar chemical property and the different ionic radius, such as scandium, yttrium, lanthanum, lutetium, for example, causes a change in the size of a crystallographic lattice or the atomic distance, wherethrough the magnitude of the conduction-electron spin polarization could be indirectly controlled (S. Legvold et al., Phys. Rev. B 16, 4986 (1977)). It is, therefore, speculated that the ratio between the two parts of the magnetization originating from the spin magnetic moment and the orbital one can be changed hereby as well, and that a zero-magnetization state can be attained at an arbitrary temperature by adjusting an amount of an atomic substitution or addition with non-magnetic elements. This method of controlling a compensation temperature with non-magnetic elements makes use of the sensitiveness of the thermal average of the total magnetic moment of samarium to the local environment effectively.

Figure 4:
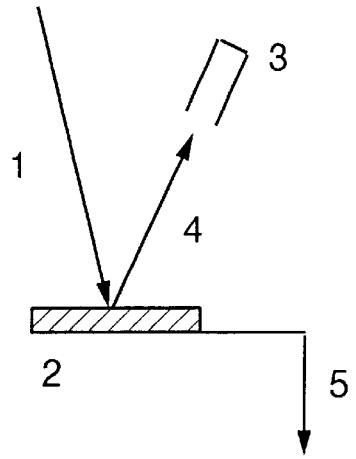
FIG. 4(*a*) is a schematic diagram of an apparatus to measure the spin polarization of an electron beam with a ferromagnetic material of the invention.
Figure 4:
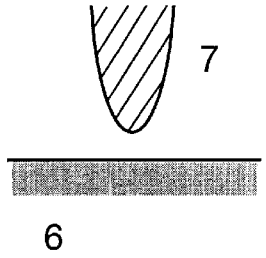
Figure 4:
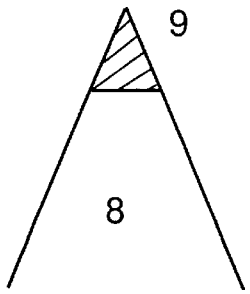

Thus, for a ferromagnetic material of the invention, the state with the ferromagnetic spin alignment over a macroscopic range and no magnetization can be materialized at an arbitrary temperature. It can be then used as, for example, a spin-resolving device for charged particles, and some examples of the embodiment are illustrated in FIG. 4. Note that, though a charged particle is displayed as a normal electron in FIG. 4, it is not restricted thereto and essentially the same mechanism may be also applied to the other charged particle, such as a positron. It should be also noted that variations of the spin-resolving devices illustrated here applicable to the field of electronics can be similarly designed by regarding an electron beam in the figure as an electric current in a conductor.

An example of the application of a ferromagnetic material of the invention to an apparatus to measure the spin polarization of an electron beam is shown in FIG. 4(*a*). In this example, a ferromagnetic material of the invention, namely a ferromagnetic samarium substance in a zero-magnetization state with the spin polarization aligned in one direction, is used as a target 2. A spin-polarized electron beam 1 collides with the target 2 and an electron beam 4 emitted from the target 2 is measured by a detector 3. It is possible to determine the degree of the spin polarization of an electron beam 1 from the spin asymmetry in the scattering or diffraction intensity of an electron beam 4 or that in an absorbed electric current 5.

Another example of the application of a ferromagnetic material of the invention to a spin-observation apparatus is shown in FIG. 4(*b*). In this example, a ferromagnetic material of the invention, namely a ferromagnetic samarium substance in a zero-magnetization state with the spin polarization aligned in one direction, is used as a probe tip 7. This probe tip 7 scans the surface of a magnetic sample 6 and the spin asymmetry in the tunneling electric current or the exchange force between the surface of the magnetic sample 6 and the probe tip 7 makes it possible to observe the surface spin structure.

Further example of the application of a ferromagnetic material of the invention to a spin-polarized electron gun is shown in FIG. 4(*c*). In this example, a ferromagnetic material of the invention, namely a ferromagnetic samarium substance in a zero-magnetization state with the spin polarization aligned in one direction, is used as the tip 9 of an electron-emission material 8. By applying an electric field to the tip 9, it becomes possible to extract spin-polarized electrons and to produce a spin-polarized electron beam.

Note that, when a ferromagnetic material of the invention is used as a spin-resolving device as illustrated here, it has to be equipped with a temperature-control system, which provides a desired thermal variation to the device, and a magnetic field-generation system, which aligns in advance the direction of the spin polarization therein, in addition.

It should be also noted that, when a ferromagnetic material of the invention is used as a spin-resolving device, its function can be further expanded by fabricating a microstructure in the device itself, such as a multi-layer structure with other magnetic or non-magnetic materials.

The details of the working principle for each apparatus shown in FIG. 4 or the like are published in R. J. Celotta et al., Phys. Rev. Lett. 43, 728 (1979), H. C. Siegmann et al., Phys. Rev. Lett. 46, 452 (1981), R. Wiessandanger et al., Phys. Rev. Lett. 65, 247 (1990), E. Kisker et al., Phys. Rev. Lett. 36, 982 (1976), and so on.

As described above, a ferromagnetic material of the invention can present various types of the temperature dependence of the magnetization similar to the case of a ferrimagnetic body, which is caused by the difference in temperature dependence between the two parts of the magnetization originating from different physical quantities, namely the spin magnetic moment and the orbital one, and it can also keep a ferromagnetic spin alignment over a macroscopic range without generating a magnetization.

Therefore, a ferromagnetic material of the invention can be used as a spin-resolving device. This application requires neither an apparatus to generate a circularly polarized laser light nor an elaborate magnetic circuit to reduce a stray magnetic field, which are incidental in the past technology, and then can lead to a cost cut.

Also, if the composition is so controlled that the magnetization-compensation temperature coincides with a boiling point of liquid nitrogen, a temperature control is not required for the spin-resolving device in operation and a further simplification of the apparatus can be made.

A ferromagnetic material of the invention, especially in using as a spin-resolving device, has some advantages as follows, too:

(1) Since the spin polarization therein can be oriented in any direction without disturbing the spin of a charged particle to produce or detect, the direction of the spin polarization of a charged particle to produce or detect can be arbitrarily selected.

(2) Since the 4f level of samarium intrinsically has a spin polarization of 100%, highly effective production or detection of a spin-polarized charged particle can be expected through the involvement of this 4f level.

(3) Since the direction of the spin polarization therein is stably kept at the magnetization-compensation state, it is possible to flip the spin in a sample and not the spin in the device by applying an external magnetic field. The difference between the measurement results for these two cases, different only in the sample spin direction, provides the effect due only to the spin polarization of the sample. This difference technique is useful to, for example, isolate the spin image from the topographical one with a spin observation apparatus shown in FIG. 4(*b*).

UTILIZABILITY OF INDUSTRIES

Since a ferromagnetic material of the invention can keep a ferromagnetic spin alignment over a macroscopic range without generating a magnetization through an appropriate preliminary thermomagnetic process, it can be suitably used as the spin-resolving device, which measures the spin polarization for a charged-particle flow, or produces a spin-polarized electron beam, or polarizes or analyzes the spin in an electric current, or observes the surface spin structure.

What is claimed is:

1. A method of controlling the magnetic properties of a ferromagnetic samarium substance having a composition including samarium from which said magnetic properties mainly arise, comprising the steps of:

(a) adjusting said composition to maintain ferromagnetic alignment of electron spin and to have a spin-orbital compensation property at a specific temperature, characterized by little or no magnetization due to the compensation between the two parts of the magnetization originating from orbital magnetic moment and spin magnetic moment;

(b) aligning the electron spin in said ferromagnetic samarium substance over a macroscopic range in a temperature range, where said ferromagnetic samarium substance has a macroscopic magnetization; and (c) setting temperature to be said spin-orbital compensation temperature and setting an external magnetic field to be nearly zero so as to achieve the ferromagnetic alignment of the electron spin in said ferromagnetic samarium substance over a macroscopic range with little or no magnetic field.

2. A method as set forth in claim 1, and wherein the step of adjusting said composition includes incorporating an element different from samarium in said ferromagnetic samarium substance so that said spin-orbital compensation property can be attained at an arbitrary temperature.

3. A method as set forth in claim 2, wherein said step of incorporating said different element includes replacing a part of said samarium in said ferromagnetic samarium substance with said different element or adding said different element to said ferromagnetic samarium substance so as to reduce the total magnetization.

4. A method as set forth in claim 3, wherein said different element is a non-magnetic element having no magnetic moment.

5. A method as set forth in claim 3, wherein said different element is a rare-earth element, said rare-earth element having a spin magnetic moment only or a spin magnetic moment and an orbital magnetic moment in a ratio that is different from that of said samarium.

6. A ferromagnetic samarium substance having magnetic properties and a composition including samarium from which said magnetic properties mainly arise and a different element, said samarium and said different element being present in amounts sufficient to maintain a ferromagnetic alignment of electron spin in said ferromagnetic samarium substance and to have a spin-orbital compensation property characterized by little or no magnetization due to the compensation between the two parts of the magnetization originating from orbital magnetic moment and spin magnetic moment.

7. A ferromagnetic samarium substance as set forth in claim 6, wherein a part of said samarium is replaced by said different element in said composition or said different element is added to said samarium in said composition so as to reduce the total magnetization.

8. A ferromagnetic samarium substance as set forth in claim 7, wherein said different element is a non-magnetic element having no magnetic moment.

9. A ferromagnetic samarium substance as set forth in claim 7, wherein said different element is a rare-earth element having a spin magnetic moment only or a spin magnetic moment and an orbital moment in a ratio that is different from that of said samarium.

10. A method of resolving a charged-particle spin using the spin-orbital compensation property of a ferromagnetic samarium substance as set forth in any one of claims 6, 7, 8 and 9 including the steps of:

(a) aligning the electron spin in said ferromagnetic samarium substance over a macroscopic range in a temperature range, said ferromagnetic samarium substance having a macroscopic magnetization;

(b) setting a temperature of said ferromagnetic samarium substance to be a spin-orbital compensation temperature and setting an external magnetic field to be nearly zero so as to achieve the ferromagnetic alignment of the electron spin in said ferromagnetic samarium substance over a macroscopic range with little or no magnetic field;

(c) making said charged-particle interact with said ferromagnetic samarium substance so as to cause a spin-dependent phenomenon between said charged-particle and said ferromagnetic samarium substance; and (d) polarizing or analyzing said charged-particle spin through spin asymmetry of said interaction between said charged-particle and said ferromagnetic samarium substance.

11. A method as set forth in claim 10, wherein the degree of the spin polarization of a charged-particle beam or current is measured by said step of polarizing or analyzing said charged-particle spin.

12. A method as set forth in claim 10, wherein the spin state of the surface of a magnetic material is observed by said step of polarizing or analyzing said charged-particle spin.

13. A method as set forth in claim 10, wherein a spin-polarized charged-particle beam or current is generated by said step of polarizing or analyzing said charged-particle spin.

* * * * *